US007111664B2

(12) United States Patent
Itoh et al.

(10) Patent No.: US 7,111,664 B2
(45) Date of Patent: Sep. 26, 2006

(54) MOLDING DEVICE

(75) Inventors: Akira Itoh, Inazawa (JP); Kiyoshi Sawada, Inazawa (JP)

(73) Assignee: Toshihara Kanagata Kogyo Co., Ltd., Inazawa, JPX ( * ) Notice: Subject to any disclaimer, the term of this patent is extended or adjusted under 35 U.S.C. 154(b) by 0 days.

(21) Appl. No.: 11/083,791

(22) Filed: Mar. 18, 2005

(65) Prior Publication Data

US 2005/0205231 A1 Sep. 22, 2005

(30) Foreign Application Priority Data

Mar. 18, 2004 (JP) ..... 2004-078947
Feb. 28, 2005 (JP) ..... 2005-055057

(51) Int. Cl.
*B22D 17/12* (2006.01)
*B22D 18/02* (2006.01)
*B22D 27/11* (2006.01)

(52) U.S. Cl. ..... 164/319; 164/312

(58) Field of Classification Search ..... 164/120, 164/319, 320, 113, 312
See application file for complete search history.

(56) References Cited

U.S. PATENT DOCUMENTS 2,411,999 A 12/1946 Lester
4,380,261 A * 4/1983 Suzuki et al. ..... 164/120
4,846,252 A * 7/1989 Sato et al. ..... 164/120
4,884,621 A * 12/1989 Ban et al. ..... 164/4.1
5,188,165 A 2/1993 Ivansson
2003/0228389 A1 12/2003 Itoh

FOREIGN PATENT DOCUMENTS

| | | | |
|---|---|---|---|
| JP | 62-101366 | * | 5/1987 |
| JP | 7-227667 | * | 8/1995 |
| JP | 09239511 | | 9/1997 |
| WO | WO 01/05537 | | 1/2001 |
| WO | WO 03/011499 | | 2/2003 |

* cited by examiner

*Primary Examiner*—Kuang Y. Lin
(74) *Attorney, Agent, or Firm*—Workman Nydegger

(57) ABSTRACT

A molding device includes a lower mold unit and an upper mold unit. A molding cavity is defined between the mold units. The lower mold unit has a storing chamber connected to the molding cavity. The upper mold unit has a damper chamber connected to the molding cavity. A pressurizing rod is inserted into the damper chamber. The pressurizing rod is actuated by a cylinder. When a pushing rod pushes molten metal in the storing chamber to the cavity, an excess amount of the molten metal enters the damper chamber. Therefore, the molding operation is reliably performed even if an excessive amount of molten metal is injected into the storing chamber. Further, the pressurizing rod pressurizes the excess amount of metal in the damper chamber.

16 Claims, 12 Drawing Sheets

MOLDING DEVICE

BACKGROUND OF THE INVENTION

The present invention relates to a molding device for molding various types of products in a cavity.

A conventional molding device as shown in FIG. 12 has been proposed. The molding device comprises a fixed mold 113 and a mold-holding member 115. The fixed mold 113 is detachably mounted to a mold-holding member 112 that is fixed to a bed 111. The mold-holding member 115 is mounted so as to reciprocate along guide rails 114 in the front and rear direction (left and right direction as viewed in FIG. 12) with respect to the mold-holding member 112. A movable mold 116 is detachably mounted to the mold-holding member 115. An injection mechanism 117 is arranged at the right side of the bed 111. Molten metal such as aluminum is fed via the injection mechanism 117 into a cavity that is defined by the fixed mold 113 and the movable mold 116 that are closed to mold a product. The injection mechanism 117 comprises a sleeve 118. The sleeve 118 includes a storing chamber 119 for molten metal that extends through the mold-holding member 112 to be connected to the fixed mold 113. An injection opening 120 for molten metal is formed at an outer edge of the sleeve 118. An injection rod 121 is inserted in the storing chamber 119 and is reciprocated by a cylinder 122.

In the above molding device, molten metal is injected into the storing chamber 119 from the injection opening 120 while the movable mold 116 is closed relative to the fixed mold 113. Then, the injection rod 121 is moved forward by the cylinder 122 so that the molten metal in the storing chamber 119 is pressed into the cavity. However, when the amount of the molten metal stored in the storing chamber 119 is excessive, an excess amount of the molten metal leaks to the outside through the die faces of the molds 113, 116, which can spoil the appearance of the product. To eliminate the problem, the amount of molten metal injected into the storing chamber 119 must be accurately calculated in advance. In this case, however, the efficiency of the molding operation is reduced.

SUMMARY OF THE INVENTION

Accordingly, it is an objective of the present invention to provide a molding device that reliably performs molding operations even if an excessive amount of molten metal is injected into a storing chamber.

To achieve the foregoing objective, the present invention provides a molding device having a first mold unit and a second mold unit opposed to the first mold unit. The first and second mold units are configured to approach and separate from each other. When the first and second mold units approach each other to be closed, a molding cavity is defined between the mold units. A storing chamber is provided in at least one of the first and second mold units. The storing chamber is connected to the molding cavity. Molten material is stored in the storing chamber. The molding device further includes a pushing mechanism, a damper chamber, and a pressurizing mechanism. The pushing mechanism pushes out the molten material in the storing chamber to the molding cavity in a state where the molding cavity is defined between the first and second mold units. The damper chamber is provided in at least one of the first and second mold units. The damper chamber is configured to receive an excess amount of the molten material that cannot be accommodated in the molding cavity. The pressurizing mechanism pressurizes the excess amount of the molten material in the damper chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
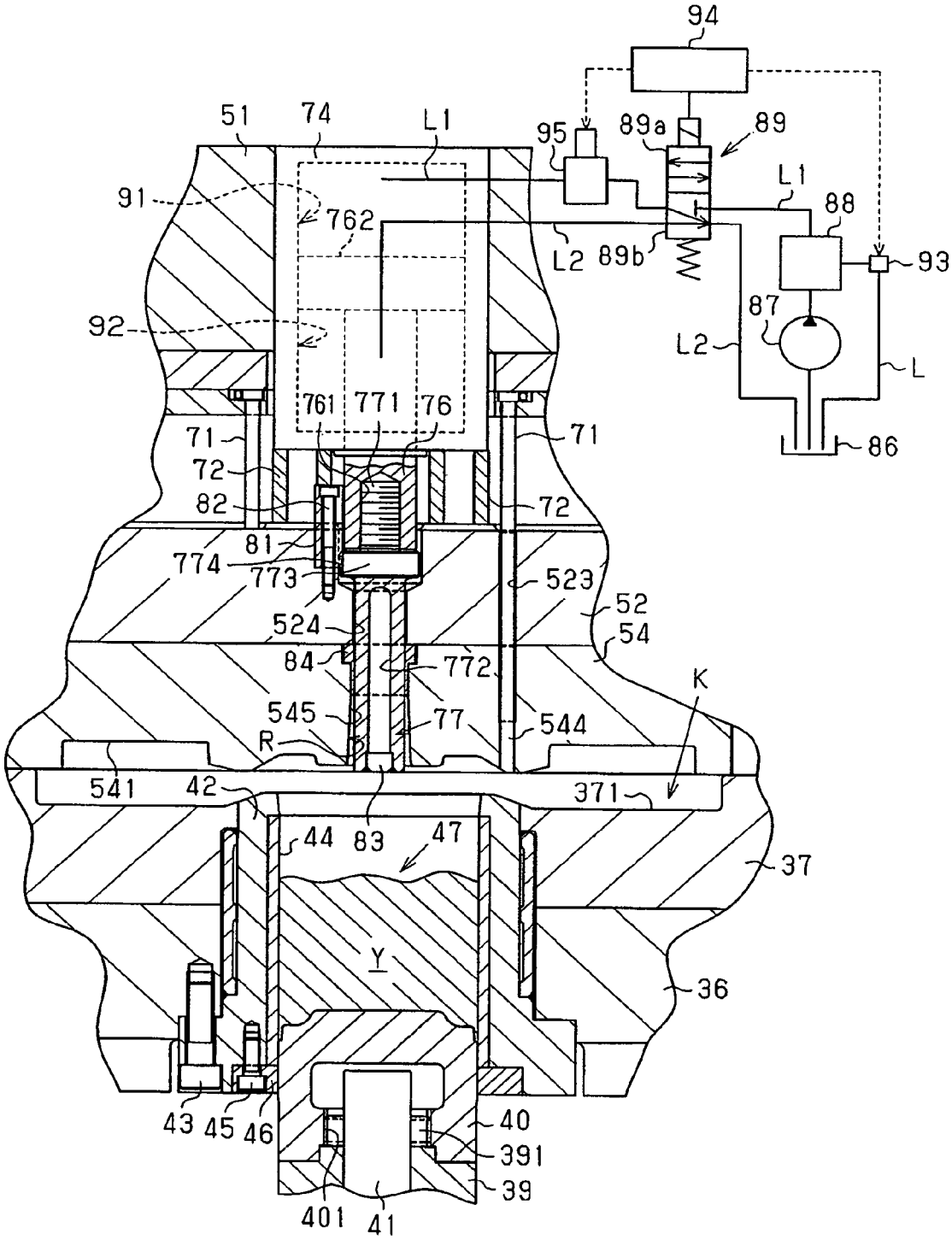
FIG. 1 is a partial cross-sectional view illustrating a molding device according to one embodiment of the present invention.

A molding device according to one embodiment of the present invention will now be described with reference to FIGS. 1 to 7.

The overall configuration of the entire molding device will now be described with reference to FIG. 7.

Legs 12 are arranged on a lower surface of a lower support stand 11 and guide supports 13 are arranged at a plurality of positions (four in this embodiment) on an upper surface of the lower support stand 11 so as to extend upward parallel to each other. An upper support stand 14 is arranged between the upper end portions of the guide supports 13. A lift plate 15 is arranged at an upper portion of the guide supports 13 so as to reciprocate up and down. The lift plate 15 is lifted or lowered by piston rods 17 of a plurality of lift cylinders 16 (only one is shown) that are fixed downwardly to the upper support stand 14. A clamping cylinder 18 is secured to the upper support stand 14 to face downward. The lower end of a piston rod 19 of the clamping cylinder 18 is coupled to the lift plate 15.

A lower mold unit 21 that serves as a first mold unit is arranged on an upper surface of the lower support stand 11 so as to be positioned between the guide supports 13. An upper mold unit 22 that serves as a second mold unit is arranged on a lower surface of the lift plate 15. A mold unit 23 comprises the lower mold unit 21 and the upper mold unit 22.

The structure of the lower mold unit 21 and the upper mold unit 22 of the mold unit 23 will be described with reference to FIG. 3.

Figure 3:
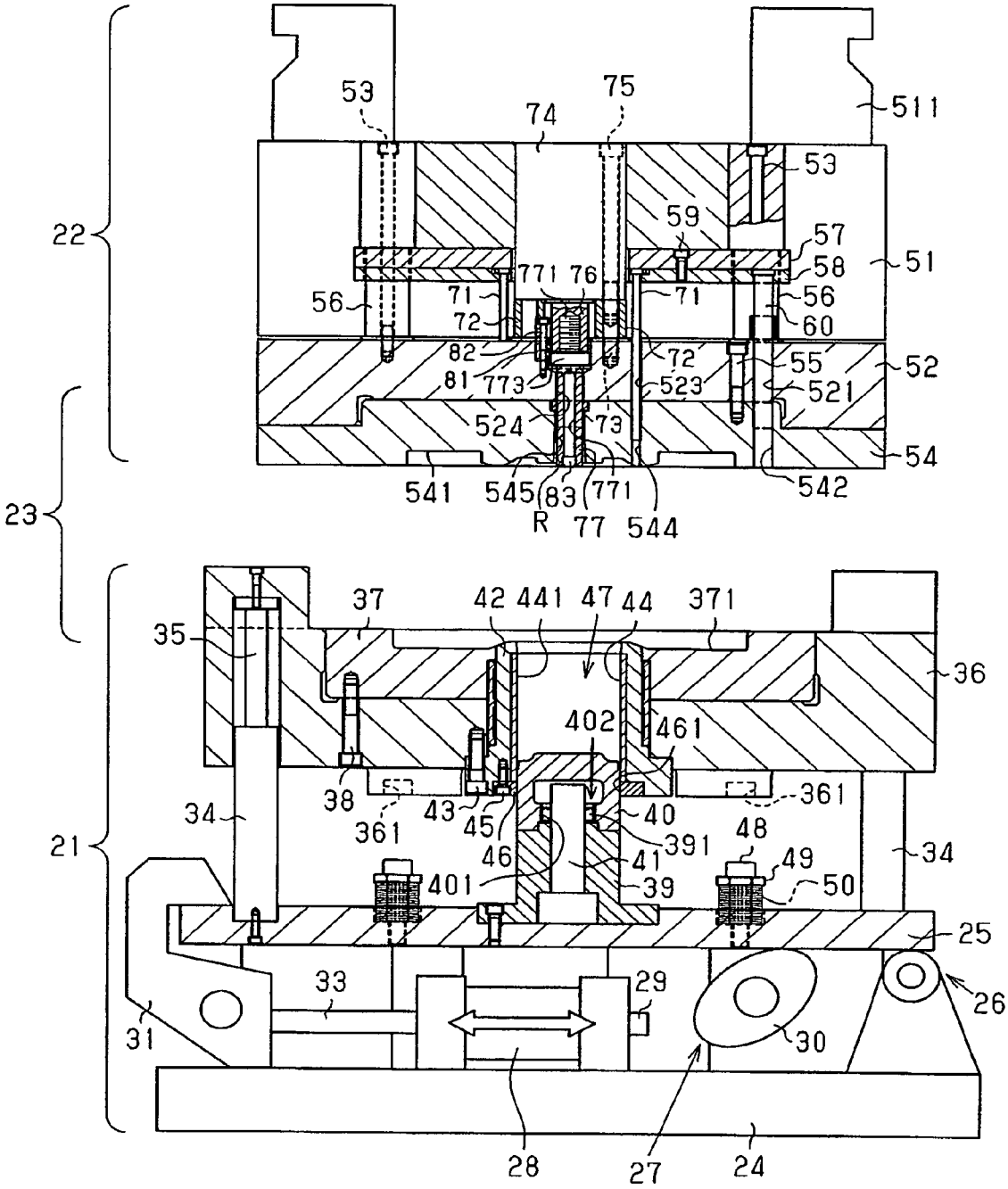
FIG. 3 is a cross-sectional view illustrating an open state of a mold unit.
Figure 7:
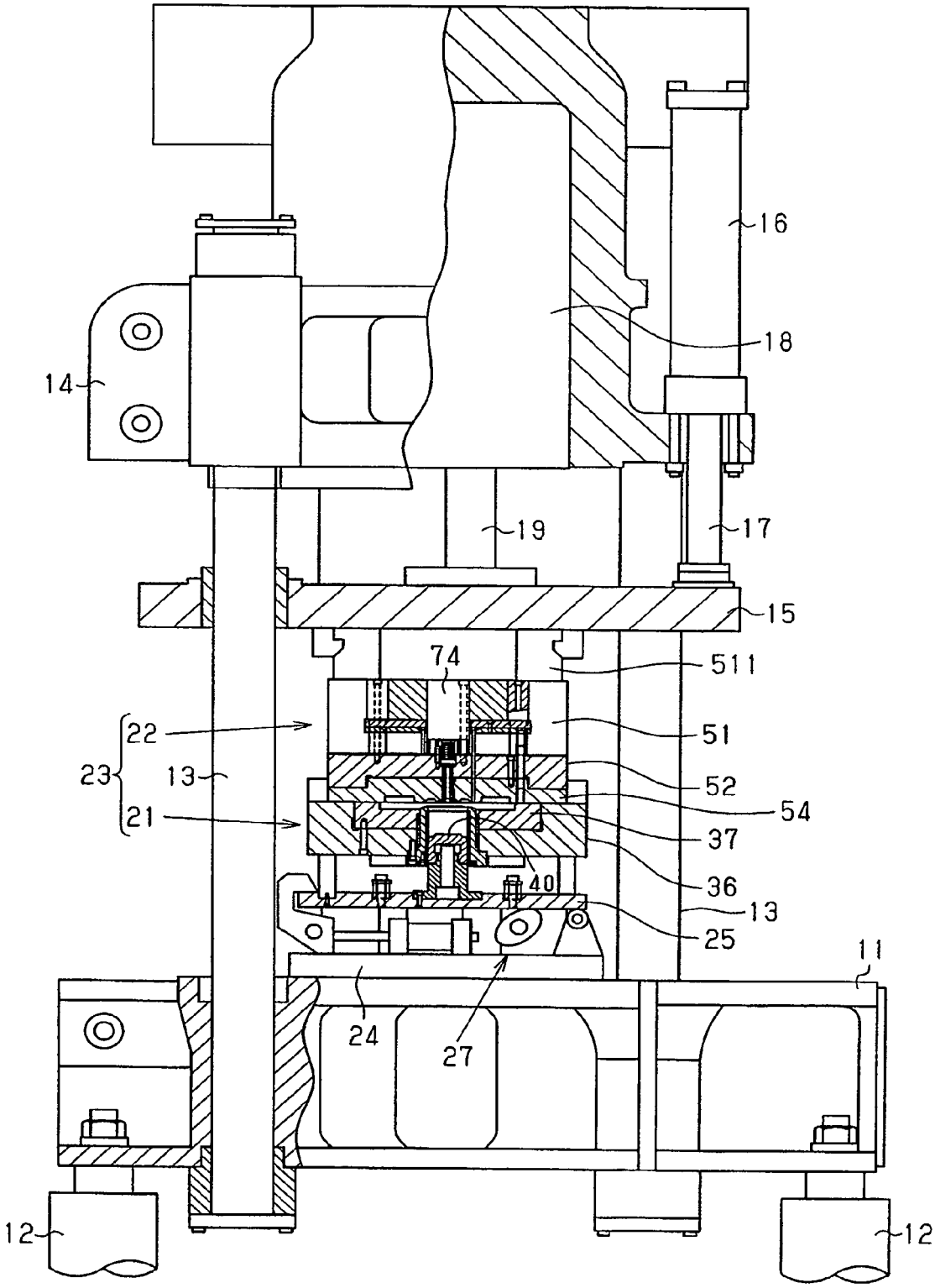
FIG. 7 is a cross-sectional view illustrating the entire molding device.

A base plate 24 of the lower mold unit 21 shown in FIG. 3 is mounted on an upper surface of the lower support stand 11 shown in FIG. 7 by a clamp mechanism (not shown). A horizontal support plate 25 is arranged on an upper surface of the base plate 24 via a hinge mechanism 26 so as to be tilted about a horizontal axis. A tilt mechanism 27 is arranged between the base plate 24 and the horizontal support plate 25 so as to tilt the horizontal support plate 25. The tilt mechanism 27 comprises a tilt cylinder 28 and a cam 30. The tilt cylinder 28 is supported horizontally on the upper surface of the base plate 24. The cam 30 is operated by a piston rod 29 of the tilt cylinder 28. A lock lever 31 is tiltably supported at the left end of the base plate 24. The lock lever 31 is maintained at a locked position for locking the horizontal support plate 25 by a piston rod 33 that extends from the left end of the tilt cylinder 28.

Two pairs of parallel cylindrical guide members 34 extend upward from the upper surface of the horizontal support plate 25 (only two guide members 34 are shown in the drawing). Each pair of the cylindrical guide members 34 is located in one of left and right end portions of the horizontal support plate 25. A support rod 35 extends upward from each cylindrical guide member 34. Each support rod 35 is retractably received by the corresponding cylindrical guide member 34. A lower mold-holding member 36 of a metal material, such as iron, is supported by the cylindrical guide members 34 and the support rods 35. The lower mold-holding member 36 is coupled to the support rods 35 and is moved vertically with the support rods 35 relative to the cylindrical guide members 34. A recess is formed on the upper surface of the lower mold-holding member 36. A lower mold 37 is detachably fastened to the recess with a bolt 38. The interior of each cylindrical guide member 34 is filled with gas. The pressure of gas permits the support rods 35 to support the lower mold-holding member 36 at a predetermined height in a floating manner.

A seat 39 is fixed at a center of the upper surface of the horizontal support plate 25. A pushing rod 40 that serves as a pushing mechanism is attached to the seat 39. An external thread 391 is formed in an upper portion of the seat 39. An internal thread 401 is formed in a lower portion of the pushing rod 40. The internal thread 401 is screwed to the external thread 391. A coolant supply member 41 is accommodated in a center portion of the seat 39 to supply coolant to a cooling jacket 402. Through the coolant supply member 41, coolant is supplied from the outside to the cooling jacket 402.

A vertically extending cylindrical member 42 is fitted to the center of the lower mold-holding member 36 and the lower mold 37. The cylindrical member 42 has a flange at a lower circumference. The flange is fastened to the lower mold-holding member 36 with a bolt 43. A cylindrical liner 44 is fitted to the inner circumferential surface of the cylindrical member 42. An annular stopper 46 having an insertion hole 461 is attached to the lower end of the cylindrical member 42 with a bolt 45. The liner 44 is held in the cylindrical member 42 by the stopper 46. The upper end of the pushing rod 40 is inserted into the stopper 46 and the liner 44. A cylindrical space defied by an inner circumferential surface 441 of the liner 44 and the upper end face of the pushing rod 40 functions as a storing chamber 47 for storing molten material. Molten metal Y, which is molten material, is injected into the storing chamber 47 from above.

Guide rods 48 extend upward from the upper surface of the horizontal support plate 25. A washer 49 is fitted about each guide rod 48 to be vertically movable. Each washer 49 is urged upward by stacked disc springs 50. Recesses 361 are formed in the lower surface of the lower mold-holding member 36 to receive the heads of the guide rods 48.

Next, the upper mold unit 22 attached to the lift plate 15 will be described. Connection members 511 are connected to the upper surface of a first upper mold-holding member 51 of a metal material. The connection members 511 are fixed to the lower surface of the lift plate 15 shown in FIG. 7 via a clamp mechanism (not shown). A second upper mold-holding member 52 is fastened to the lower surface of the first upper mold-holding member 51 with bolts 53. An upper mold 54 is detachably fastened to the lower surface of the second upper mold-holding member 52 with bolts 55. A cavity K is formed by a second molding surface 541 that is formed in the upper mold 54 and a first molding surface 371 that is formed in the lower mold 37 (see FIG. 1). A product of a predetermined shape is molded in the cavity K.

As shown in FIG. 3, the first upper mold-holding member 51 has four guide supports 56 (only two of them are shown in the drawing). The guide supports 56 support a first lift plate 57 and a second lift plate 58, which are coupled to each other with bolts 59, such that the lift plates 57, 58 are lifted and lowered by a cylinder (not shown). Guide rods 60 (only one of four is shown in the drawing) are coupled to the second lift plate 58 to extend downward. Guide passages 521 are formed in the second upper mold-holding member 52, and guide passages 542 are formed in the upper mold 54. The guide rods 60 are slidably inserted in the guide passages 521, 542.

Upper ends of pushing pins 71 are coupled to the second lift plate 58. Guide passages 523 are formed in the second upper mold-holding member 52, and guide passages 544 are formed in the upper mold 54. The pushing pins 71 are inserted in the guide passages 523, 544.

Characteristic features of the present invention will now be described with reference to FIGS. 1 and 2.

A cylindrical support member 72 is located on the upper surface of a center portion of the second upper mold-holding member 52. The support member 72 is fixed to the second upper mold-holding member 52 with bolts 73 (see FIG. 3). A hydraulic cylinder 74 is vertically placed on the upper surface of the support member 72. The cylinder 74 is fixed to the support member 72 with bolts 75 (see FIG. 3).

Figure 2:
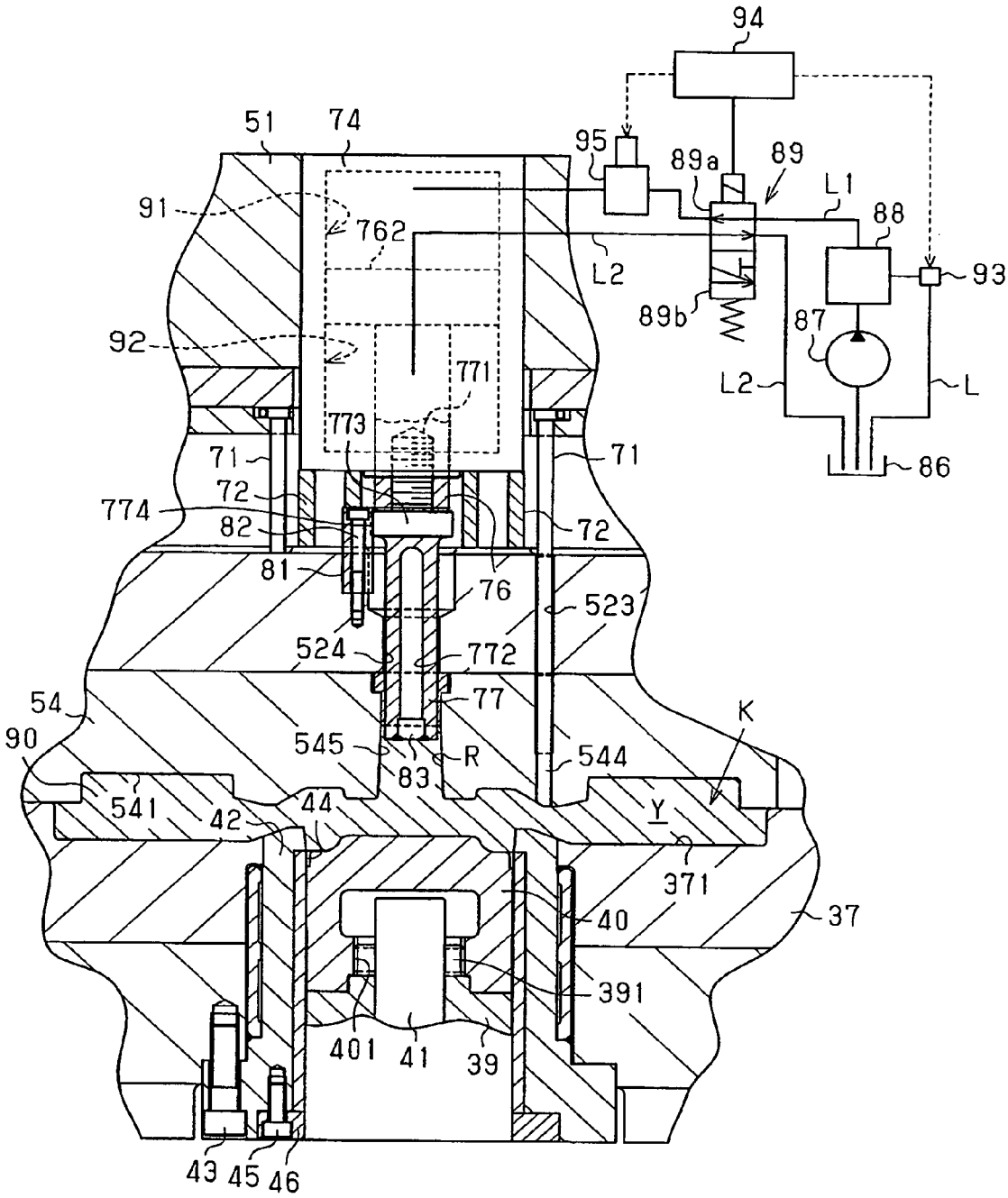
FIG. 2 is a cross-sectional view illustrating the molding device of FIG. 1, when molding is completed.

As shown in FIG. 1, a piston rod 76 of the cylinder 74 is coupled to a pressurizing rod 77, which functions as a pressurizing member. An external thread 771 formed on an upper portion of the pressurizing rod 77 is screwed to an internal thread formed in the piston rod 76.

A coolant passage 772 is formed along the axis of the pressurizing rod 77. Coolant is supplied to the passage 772 from the outside. A flange 773 is integrally formed with an upper end of the pressurizing rod 77. A keyway 774 extending along the axis of the pressurizing rod 77 is formed in the flange 773. A key 81 extending along the axis of the pressurizing rod 77 is fixed to an upper portion of the second upper mold-holding member 52 with a bolt 82. The key 81 is engaged with the keyway 774 to prevent the pressurizing rod 77 from rotating about the axis. A lower opening of the passage 772 is closed by an airtight stopper 83.

A guide passage 524 and a guide passage 545 for guiding the pressurizing rod 77 are formed in the second upper mold-holding member 52 and the upper mold 54, respectively. A seal member 84 is fitted in a guide passage 545 of the upper mold 54. The space between the inner circumferential surface of the guide passage 545 and the pressurizing rod 77 is sealed with the seal member 84. A portion of the pressurizing rod 77 that is located in the guide passage 545 defines a damper chamber R for receiving excess molten metal in the guide passage 545.

The cylinder 74 has a piston 762 that is coupled to the piston rod 76. The piston 762 divides the interior of the cylinder 74 into a first cylinder chamber 91 and a second cylinder chamber 92. The piston rod 76 extends through the second cylinder chamber 92. The first cylinder chamber 91 is connected to a pressurized fluid supply source, which includes an oil tank 86 and a hydraulic pump 87, with a first conduit L1. The second cylinder chamber 92 is connected to the oil tank 86 with a second conduit L2. A first electromagnetic switch valve 89 is located in the paths of the first conduit L1 and the second conduit L2. An accumulator 88 is located in the first conduit L1 between the first electromagnetic switch valve 89 and the hydraulic pump 87.

The first electromagnetic switch valve 89 has a supply port section 89*a* and a drain port section 89*b*, and is switched between a supply state (see FIG. 2), in which the supply port section 89*a* is connected to the first and second conduits L1, L2, and a drain state (see FIG. 1), in which the drain port section 89*b* is connected to the first and second conduits L1, L2. When the first electromagnetic switch valve 89 is switched to the supply state, hydraulic oil is permitted to be supplied to the first cylinder chamber 91 from the hydraulic pump 87 through the first conduit L1. Also, the second cylinder chamber 92 is connected to the oil tank 86 through the second conduit L2. Accordingly, the pressurizing rod 77 is permitted to be moved downward. On the other hand, when the first electromagnetic switch valve 89 is switched to the drain state, the first cylinder chamber 91 is connected to the oil tank 86 through parts of the first and second conduits L1, L2. At the same, the second cylinder chamber 92 is connected to the oil tank 86 through the second conduit L2.

The accumulator 88 is connected to a conduit L for returning oil to the oil tank 86. A relief valve 93 is located in the conduit L. In response to a control signal from a control unit 94, the relief valve 93 maintains the pressure in the accumulator 88 substantially to a constant level. A first pressure regulating valve 95 is located in a section of the first conduit L1 between the first electromagnetic switch valve 89 and the cylinder 74. In a state where the first electromagnetic switch valve 89 is switched to the supply state shown in FIG. 2, the first pressure regulating valve 95 adjusts the pressure of hydraulic oil supplied to the first cylinder chamber 91 in response to a control signal from the control unit 94. Also, when the first electromagnetic switch valve 89 is switched to the drain state shown in FIG. 1, hydraulic oil in the first cylinder chamber 91 is drained to the oil tank 86. At this time, in response to a control signal from the control unit 94, the first pressure regulating valve 95 adjusts the amount of oil drained from the first cylinder chamber 91, thereby controlling the pressure in the first cylinder chamber 91 to a predetermined level.

In the present embodiment, the cylinder 74 having the piston rod 76, the pressurizing rod 77, the hydraulic pump 87, the accumulator 88, the first electromagnetic switch valve 89, and the first pressure regulating valve 95 form a pressurizing mechanism.

Although not illustrated, the lower mold unit 21 has a cooling mechanism for cooling the lower mold, and the upper mold unit 22 has a cooling mechanism for cooling the upper mold 54.

Operations of the thus configured molding device will now be described.

Figure 4:
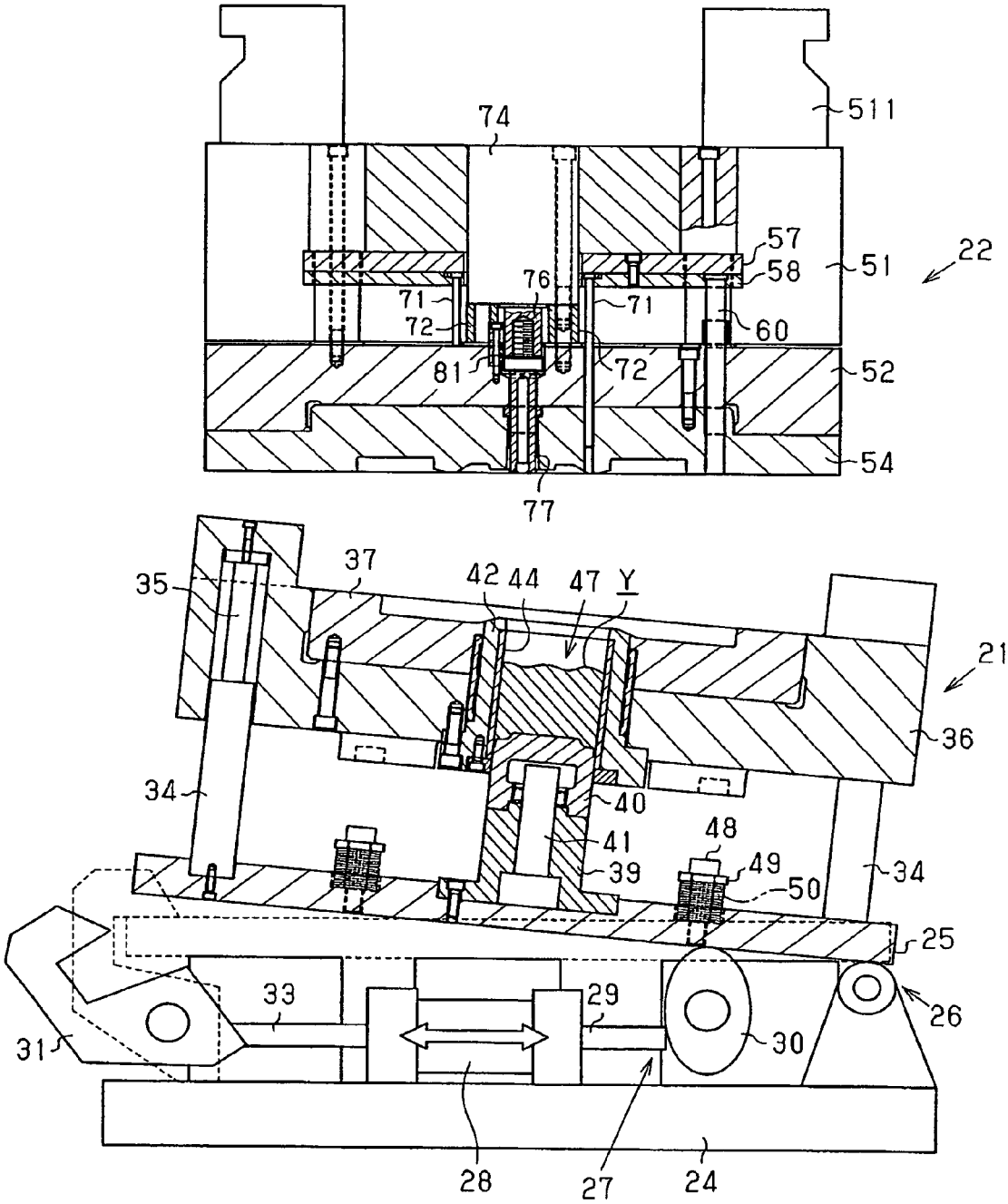
FIG. 4 is a cross-sectional view illustrating a lower mold-holding member of a lower mold unit when the lower mold-holding member is tilted.

FIG. 3 illustrates an open state of the molding device, in which the upper mold unit 22 is separated upward from the lower mold unit 21. The first electromagnetic switch valve 89 shown in FIG. 1 is switched to the drain state. The pressurizing rod 77 is has been moved to the lowest position (most projection position), so that the volume of the damper chamber R is minimized. In this state, the piston rod 33 of the tilt cylinder 28 is retreated (moved to the right as viewed in FIG. 3), so that the lock lever 31 is unlocked. At the same time, the piston rod 29 of the tilt cylinder 28 is advanced (moved to the right as viewed in FIG. 3), so that the piston rod 29 rotates the cam 30. Then, as shown in FIG. 4, the horizontal support plate 25 and the lower mold-holding member 36 are rotated clockwise about the hinge mechanism 26 and tilted. In the tilted state, molten metal Y is injected into the storing chamber 47. The inclination angle of the lower mold-holding member 36 relative to a horizontal plane can be adjusted in a range from 10° to 60° by changing the shape of the cam 30.

Figure 5:
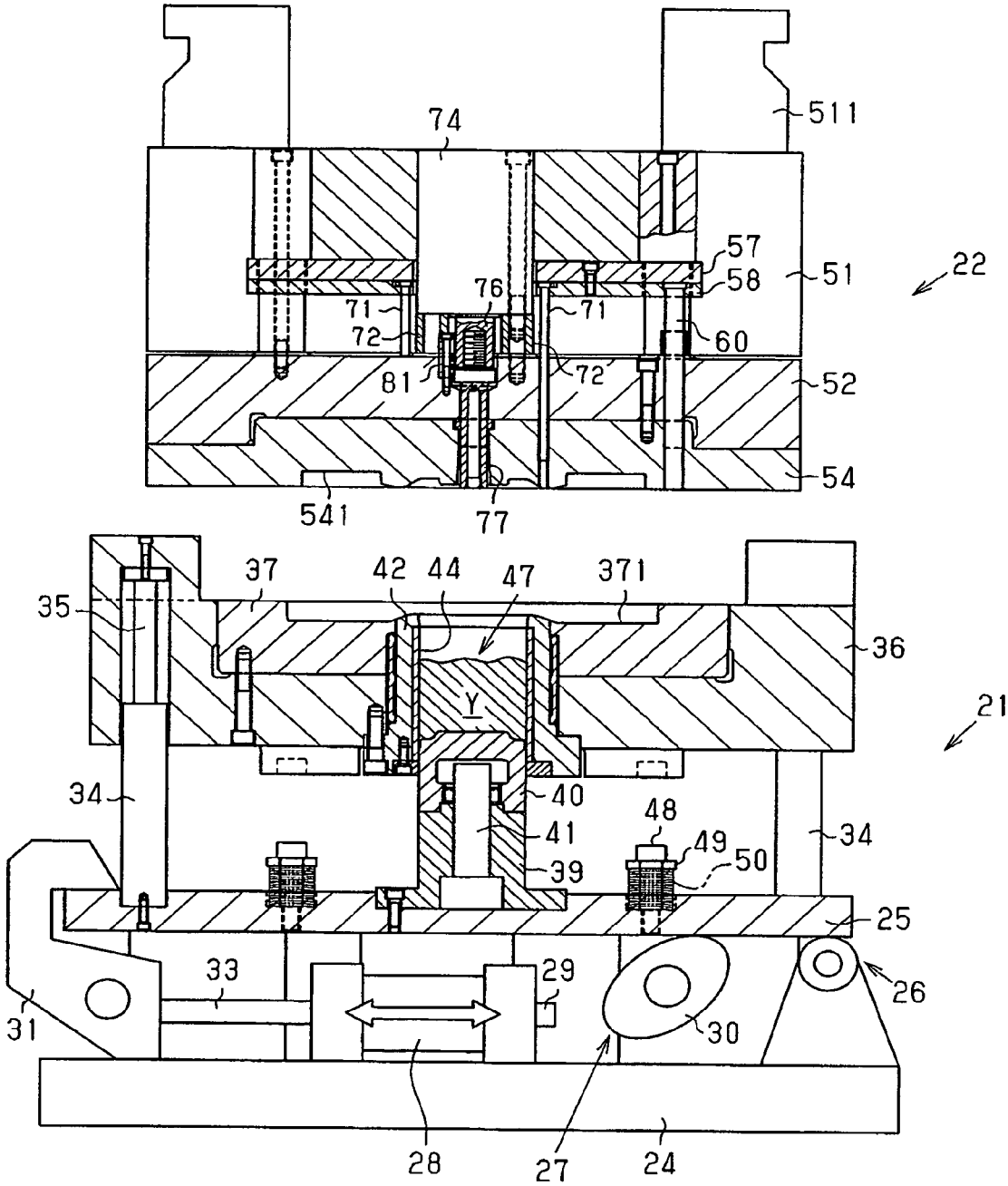
FIG. 5 is a cross-sectional view illustrating a storing chamber when molten metal is stored in the storing chamber.

Next, the piston rod 29 of the tilt cylinder 28 is retreated, so that the horizontal support plate 25 and the lower mold-holding member 36 are returned to the horizontal state as shown in FIG. 5. At the same time, the piston rod 33 is projected to rotate the lock lever 31, so that the lock lever 31 locks the left end portion of the horizontal support plate 25.

Figure 6:
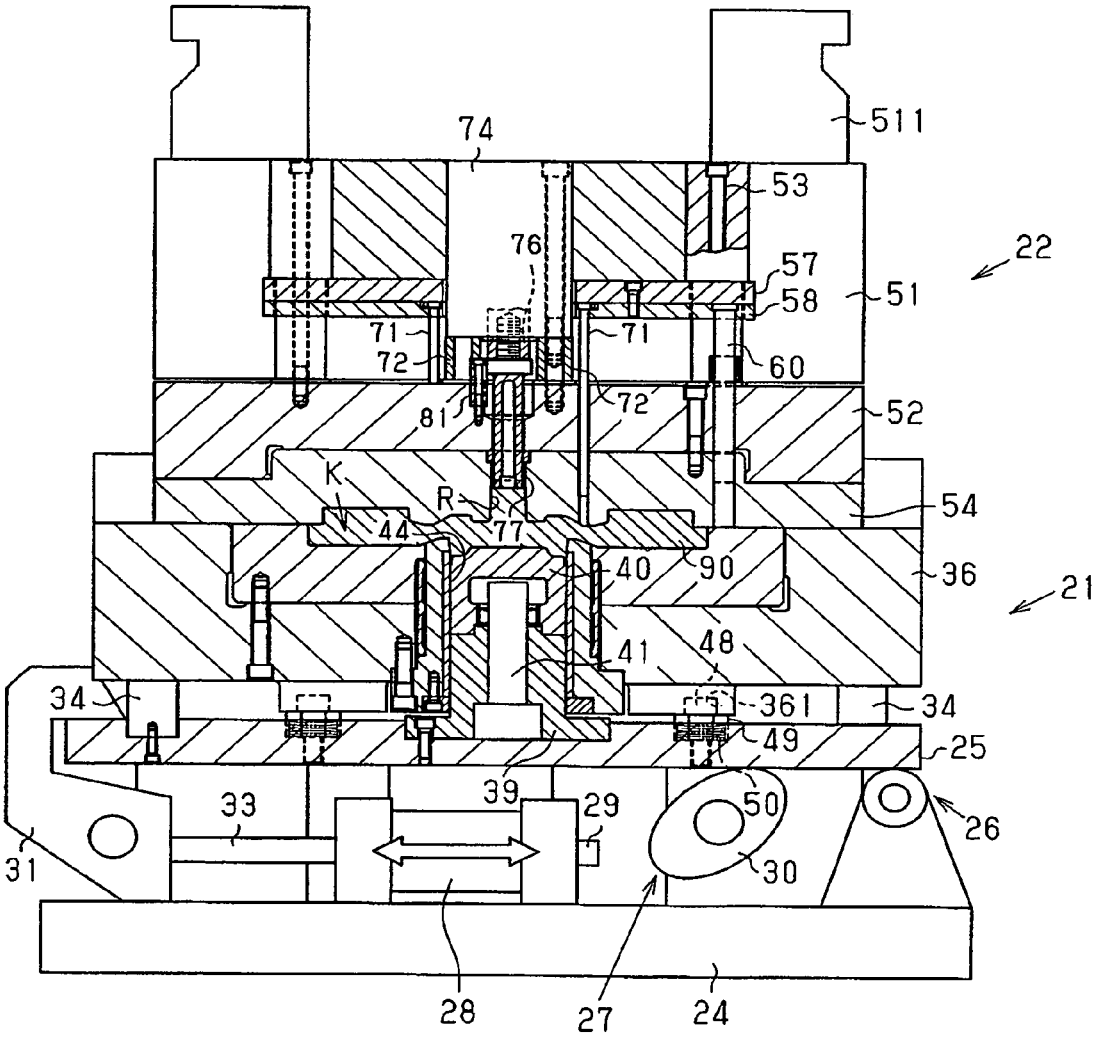
FIG. 6 is a cross-sectional view illustrating the mold unit when molding is completed.

Subsequently, as shown in FIG. 6, the upper mold unit 22 is moved downward to a mold closing height position at which the lower surface of the upper mold 54 contacts the lower mold-holding member 36 and the lower mold 37. At this time, the upper mold 54 moves the lower mold-holding member 36 downward. As the lower mold-holding member 36 is moved downward, the pushing rod 40 and the liner 44 are moved relative to each other, which pushes the molten metal Y stored in the storing chamber 47 into the cavity K. As a result, a product 90 having a shape corresponding to the shape of the cavity K is molded.

In the state of FIG. 6, a stopper (not shown) formed on the lower surface of the lower mold-holding member 36 contacts the upper surface of the horizontal support plate 25 to prevent the lower mold-holding member 36 from further moving downward. The disc springs 50 on the horizontal support plate 25 are pressed against the lower mold-holding member 36 and deformed, accordingly. The disc springs 50 in turn press the lower mold 37 against the upper mold 54. The upper mold 54 is clamped to the lower mold 37 by the clamping cylinder 18 (see FIG. 7).

An excess amount of the molten metal Y that cannot be accommodated in the cavity K pushes and moves the pressurizing rod 77 upward, and enters the damper chamber R. At this step, the first electromagnetic switch valve 89 is switched to the drain state (see FIG. 1). The first pressure regulating valve 95 in the first conduit L1 is controlled by the control unit 94 such that the pressure in the first cylinder chamber 91 seeks the predetermined pressure. Therefore, when the pressurizing rod 77 is moved upward by the excess amount of the molten metal Y, the pressurizing rod 77 receives a predetermined dynamic resistance.

After the pressurizing rod 77 is moved to the uppermost position in the final stage of the molding procedure, the first electromagnetic switch valve 89 is switched from the drain state to the supply state in response to a switching signal from the control unit 94. Therefore, hydraulic oil is supplied to the first cylinder chamber 91, and the pressurizing rod 77 is pressed downward to pressurize the excess amount of the molten metal Y in the damper chamber R. At this time, the first pressure regulating valve 95 controls the pressure in the damper chamber R to a predetermined pressure.

When the molding of the product 90 is completed in this manner, the clamping operation by the clamping cylinder 18 is stopped, and the lift cylinders 16 are actuated to lift the upper mold unit 22. Accordingly, the upper mold-holding member 51 and the upper mold 54 are lifted together with the product 90. The upper mold-holding member 51 and the upper mold 54 are held at the open state. Subsequently, the first and second lift plates 57, 58 are moved downward by a cylinder (not shown). Accordingly, the pushing pins 71 are moved downward to push the product 90, which is in turn separated from the second molding surface 541.

The above described embodiment provides the following advantages.

(1) The storing chamber 47 for the molten metal Y is defined in the lower mold unit 21. In synchronization with the mold closing operation of the lower mold unit 21 and the upper mold unit 22, the molten metal Y in the storing chamber 47 is pushed into the cavity K by the pushing rod 40. Therefore, unlike conventional molding devices, the molding device of the above embodiment does not require an externally attached injection mechanism. Thus, the device has a simple structure and a reduced size. Also, the molding device is easily manufactured, and the costs are reduced. Since the molten metal Y is supplied to the interior of the cavity K in synchronization with the mold closing operation of the lower mold unit 21 and the upper mold unit 22, one step of the molding procedure is eliminated. This improves the efficiency of the procedure.

(2) The damper chamber R is defined in the upper mold 54. The pressure in the first cylinder chamber 91 of the cylinder 74 that actuates the pressurizing rod 77 is adjusted to a predetermined pressure set by the first pressure regulating valve 95. An excess amount of the molten metal Y that cannot be accommodated in the cavity K pushes and moves the pressurizing rod 77, and enters the damper chamber R. Therefore, an excess amount of the molten metal Y is permitted to escape from the cavity K. This prevents molten metal from entering between die faces of the lower mold 37 and the upper mold 54 and spoiling the appearance of the product.

Also, since the amount of the molten metal Y in the storing chamber 47 does not need to be accurately controlled, injection of the molten metal Y into the storing chamber 47 can be quickly performed, which improves the efficiency of the molding procedure.

(3) When pushing of the molten metal Y by the pushing rod 40 is started, the pressurizing rod 77 is at the position where the volume of the damper R is minimized. As the pushing progresses and the excess amount of the molten metal Y flows into the damper chamber R, the pressurizing rod 77 is moved toward a position at which the volume of the damper chamber R is maximized. That is, after the molten metal Y that is pushed from the storing chamber 47 by the pushing rod 40 fills the entire cavity K, the excess amount of the molten metal Y pushes and moves the pressurizing rod 77, and enters the damper chamber R. This prevents the product 90 from being defective.

(4) After the pushing rod 40 pushes the molten metal Y to the cavity K, the first electromagnetic switch valve 89 is switched from the drain state to the supply state, so that the pressurizing rod 77 pressurizes the molten metal Y in the damper chamber R. This prevents shrinkage cavities from being formed in the product 90. Accordingly, the hardness (density) and the quality of the product 90 are improved. It may be configured that the pressurizing rod 77 starts pressurizing the molten metal Y in the damper chamber R at the final stage of pushing by the pushing rod 40, in other words, immediately before the pushing is finished.

(5) When in the open state shown in FIG. 4, the lower mold-holding member 36 of the lower mold unit 21 is tilted by the tilt mechanism 27. Therefore, the molten metal Y is easily injected into the storing chamber 47. Also, the molten metal Y is prevented from foaming so that bubbles are not mixed with the molten metal Y.

(6) Since the cylinder 74, the pressurizing rod 77, and other components form the pressurizing mechanism, the pressurizing mechanism is manufactured at a low cost.

(7) Since the pushing rod 40 forms the pushing mechanism, the structure of the molding device is simplified and the costs are reduced.

Another embodiment of the present invention will now be described with reference to FIGS. 8 to 10. The differences from the embodiment shown in FIGS. 1 to 7 will mainly be discussed. Like or the same reference numerals are given to those components that have the same functions as the corresponding components of the embodiment of FIGS. 1 to 7.

Figure 8:
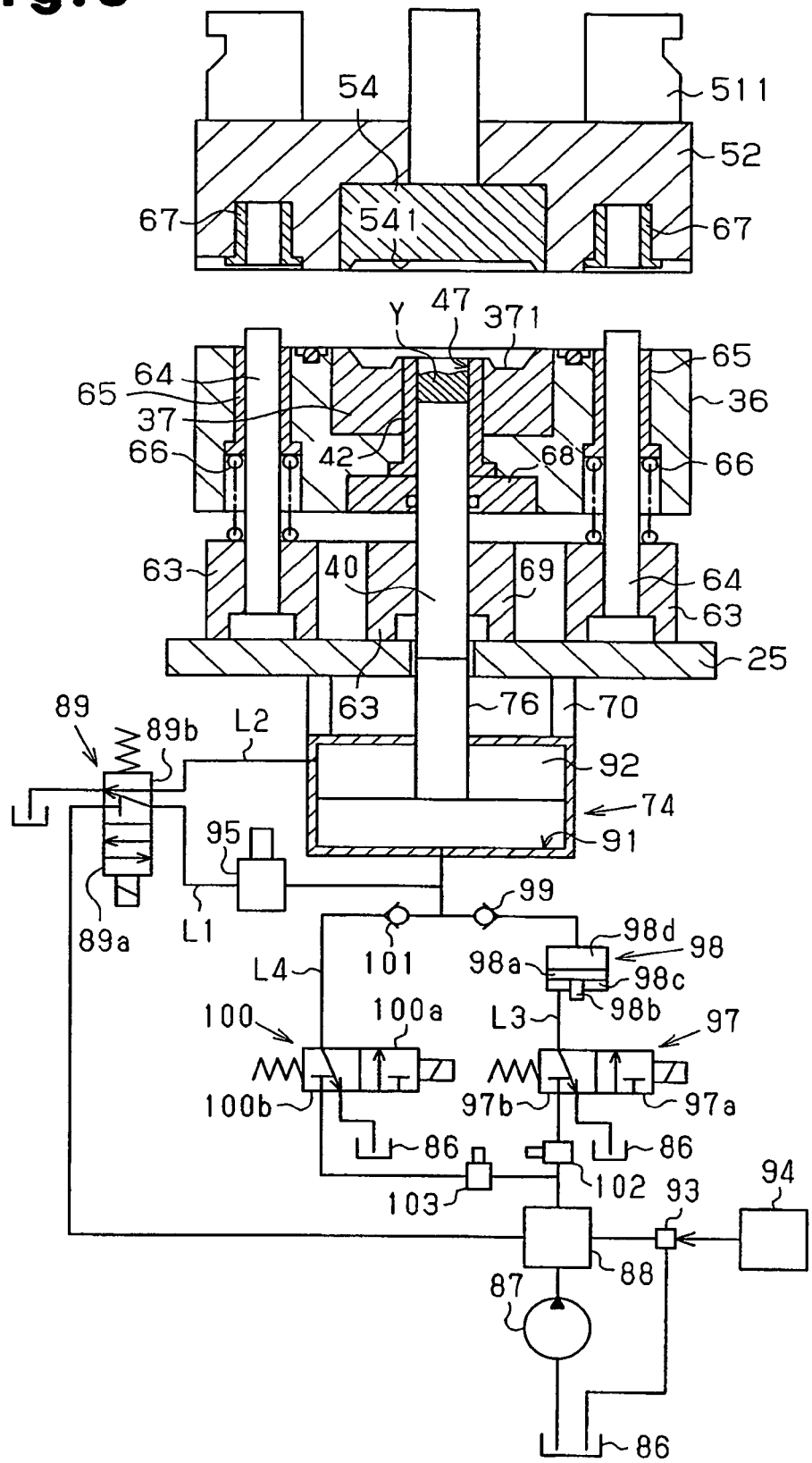
FIG. 8 is a cross-sectional view illustrating a molding device according to another embodiment of the present invention.
Figure 9:
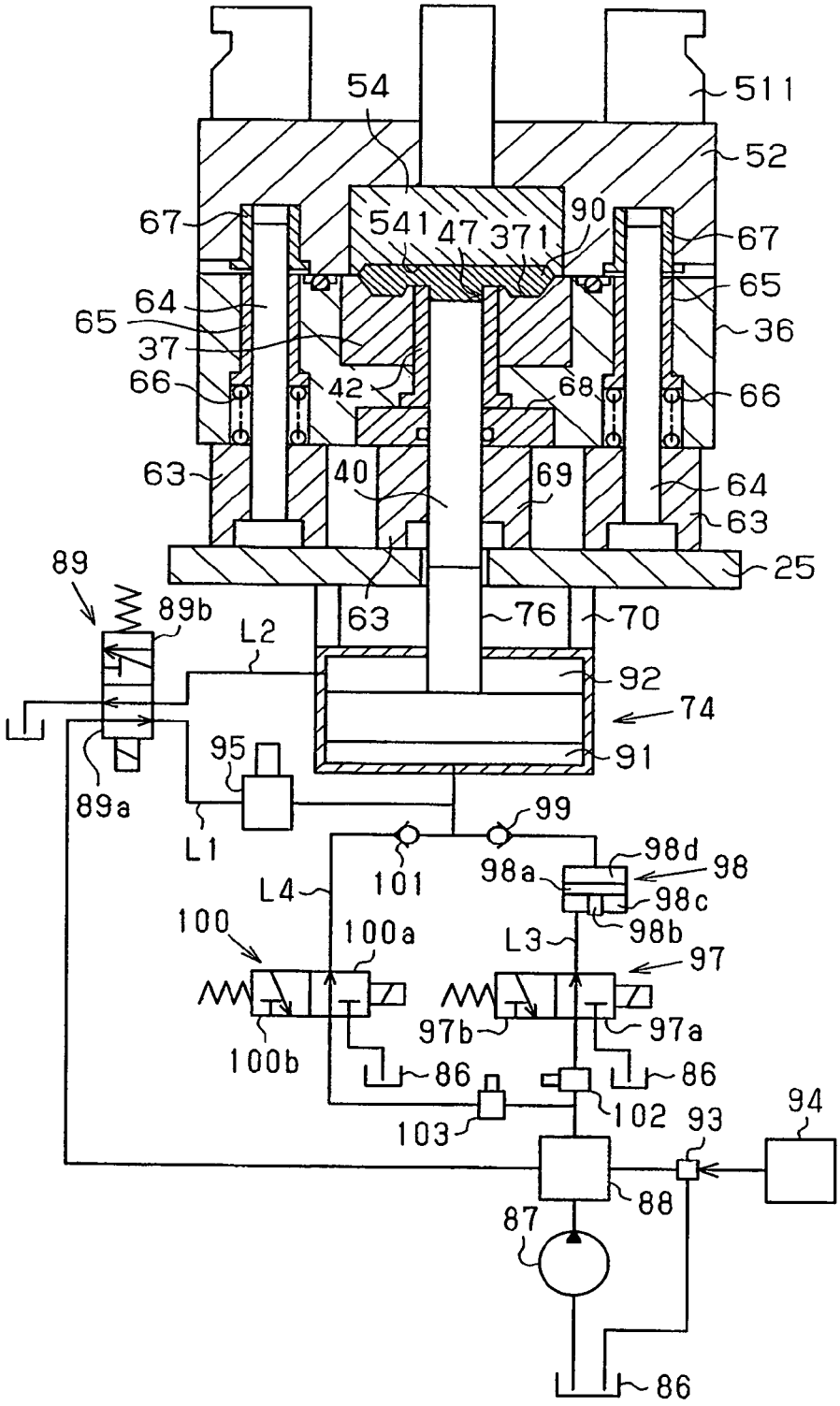
FIG. 9 is a cross-sectional view illustrating the molding device of FIG. 8, in a closed state.

In a molding device of this embodiment, the damper chamber R, which is provided above the upper mold unit 22, and the pressurizing rod 77 in the embodiment shown in FIGS. 1 to 7, are omitted as shown in FIG. 8. Instead, the storing chamber 47 has the function of the damper chamber R, and the pushing rod 40 has a function of the pressurizing rod 77 (pressurizing member).

As shown in FIG. 8, the upper mold 54 is directly attached to the second upper mold-holding member 52. Upright support rods 64 are provided on the upper surface of the horizontal support plate 25. Each support rod 64 is supported by a base 63. Guide cylinders 65, each corresponding to one of the support rod 64, are assembled with the lower mold-holding member 36. The guide cylinders 65 can be lifted or lowered. A coil spring 66 is located between the lower surface of each guide cylinder 65 and the upper surface of the corresponding base 63. The coil springs 66 urge the lower mold-holding member 36 upward. Guide cylinders 67, each corresponding to one of the support rods 64, are provided in a lower portion of the second upper mold-holding member 52. Each guide cylinder 67 receives the upper end of the corresponding support rod 64.

A support member 68 is fixed to the lower portion of the lower mold-holding member 36 with a bolt (not shown). The support member 68 supports the lower end of the cylindrical member 42 attached to the lower mold-holding member 36. A guide member 69 is attached to the upper surface of the horizontal support plate 25. The pushing rod 40 extends through the guide member 69.

The cylinder 74 is attached to the lower surface of the horizontal support plate 25 with a bracket 70. The cylinder 74 forms part of a pressurizing mechanism. The upper end of the piston rod 76 of the cylinder 74 is coupled to the lower end of the pushing rod 40.

The accumulator 88 and the first cylinder chamber 91 of the cylinder 74 are connected with each other by a third conduit L3 and a fourth conduit L4, which are parallel. A second electromagnetic switch valve 97, an acceleration cylinder 98, and a first check valve 99 are provided in the third conduit L3. A third electromagnetic switch valve 100 and a second check valve 101 are provided in the fourth conduit L4. The acceleration cylinder 98 has a piston 98*a*, a rod 98*b*, a pressurizing chamber 98*c*, and an actuation chamber 98*d*, the volume of which is greater than that of the pressurizing chamber 98*c*. When hydraulic oil is supplied to the pressurizing chamber 98*c*, hydraulic oil in the actuation chamber 98*d* is supplied to the first cylinder chamber 91 at a high flow rate.

The second electromagnetic switch valve 97 has a supply port section 97*a* and a drain port section 97*b*, and is switched between a supply state (see FIG. 9), in which the supply port section 97*a* is connected to the third conduit L3, and a drain state (see FIG. 8), in which the drain port section 97*b* is connected to the third conduit L3. When the second electromagnetic switch valve 97 is switched to the supply state, hydraulic oil is permitted to be supplied to the pressurizing chamber 98*c* of the acceleration cylinder 98 from the hydraulic pump 87. On the other hand, when the second electromagnetic switch valve 97 is switched to the drain state, the pressurizing chamber 98*c* is connected to the oil tank 86.

The third electromagnetic switch valve 100 has a supply port section 100*a* and a drain port section 100*b*, and is switched between a supply state (see FIG. 9), in which the supply port section 100*a* is connected to the fourth conduit L4, and a drain state (see FIG. 8), in which the drain port section 100*b* is connected to the fourth conduit L4. When the third electromagnetic switch valve 100 is switched to the supply state, hydraulic oil is permitted to be supplied to the first cylinder chamber 91 from the hydraulic pump 87. On the other hand, when the third electromagnetic switch valve 100 is switched to the drain state, the fourth conduit L4 is connected to the oil tank 86.

A second pressure regulating valve 102 is located in the third conduit L3. The second pressure regulating valve 102 sets the pressure applied to the first cylinder chamber 91 to a low pressure. A third pressure regulating valve 103 is located in the fourth conduit L4. The third pressure regulating valve 103 sets the pressure applied to the first cylinder chamber 91 to a high pressure. The second electromagnetic switch valve 97 and the second pressure regulating valve 102 provided in the third conduit L3 function as a low pressure supply mechanism that supplies fluid of a relatively low pressure to the cylinder chamber 91. The third electromagnetic switch valve 100 and the third pressure regulating valve 103 provided in the fourth conduit L4 function as a high pressure supply mechanism that supplies fluid of a relatively high pressure to the cylinder chamber 91.

Other than to the first electromagnetic switch valve 89 and the first pressure regulating valve 95, the control unit 94 sends control signals to the second and third electromagnetic switch valves 97, 100 and the second and third pressure regulating valves 102, 103. The other structures are the same as the molding device according to the embodiment of FIGS. 1 to 7.

Operations of the thus configured molding device will now be described.

FIG. 8 illustrates the molding device before a molding operation is started. The upper mold 54 is separated upward from the lower mold 37. The lower mold 37 is held at a predetermined height by means of the coil springs 66. In this state, the first to third electromagnetic switch valves 89, 97, 100 are each switched to the drain state, and the piston rod 76 and the pushing rod 40 are held at the lowermost positions.

Figure 10:
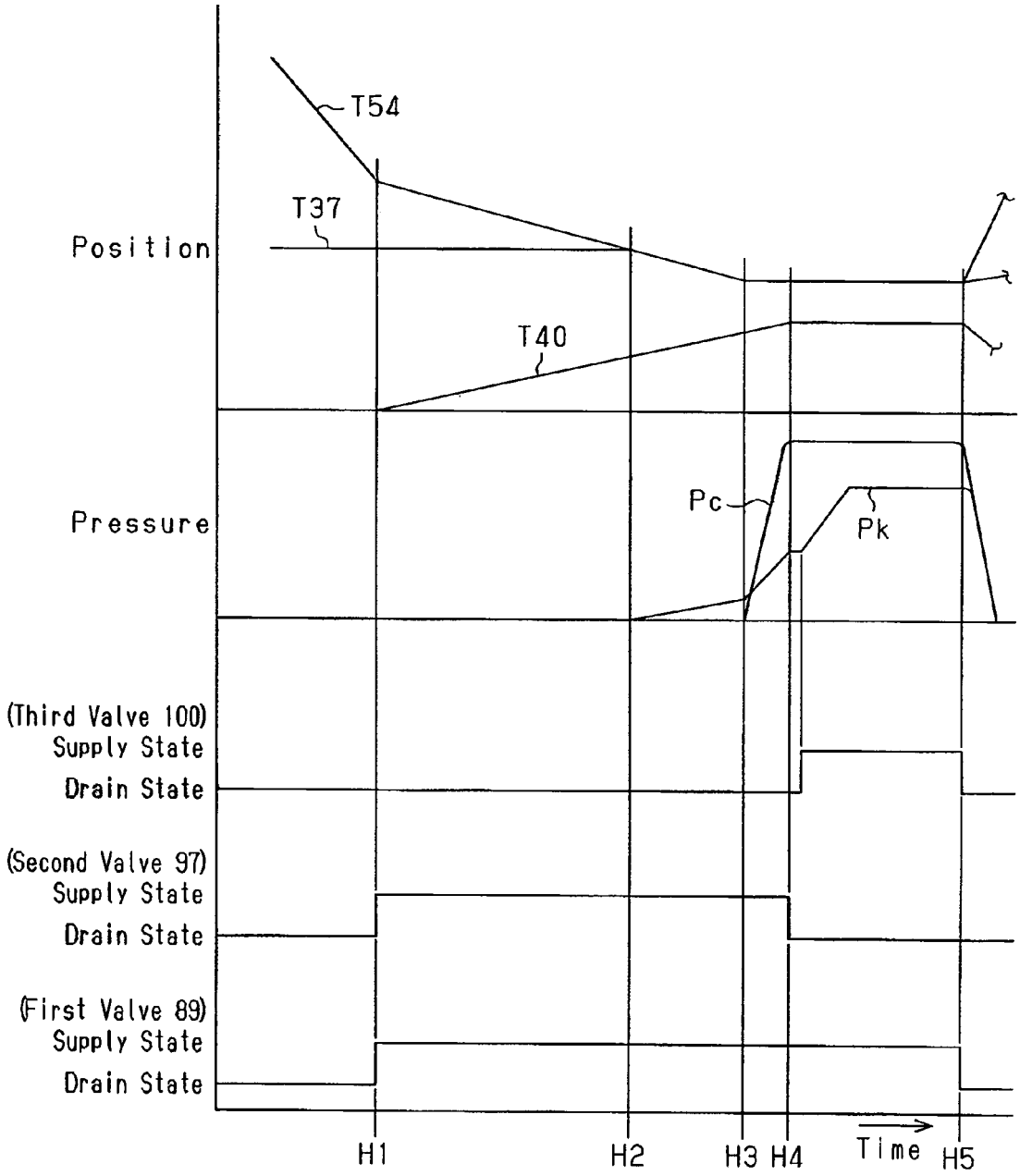
FIG. 10 is a timing chart showing an operation of the molding device shown in FIG. 8.

The molding operation is carried out as shown in the timing chart of FIG. 10. That is, as indicated by line T54, the upper mold 54 is lowered relatively quickly. When the upper mold 54 reaches a mold starting position at time H1, the lowering speed of the upper mold 54 is switched to a low speed. The upper mold 54 is further lowered at the lower speed. At time H1 when the upper mold 54 reaches the mold starting position, the first and second electromagnetic switch valves 89, 97 are each switched from the drain position to the supply position. Accordingly, the cylinder 74 is actuated, and the pushing rod 40 is moved upward as indicated by line T40 in FIG. 10. Therefore, the molten metal Y stored in the storing chamber 47 is pushed into the cavity K of the molding device in the open state, or pushed onto the first molding surface 371 of the lower mold 37.

When the upper mold 54 is being moved downward, the lower mold 37 is held at a predetermined height as indicated by line T37 in FIG. 10. At time H2, which is a predetermined time after time H1, the upper mold 54 contacts the lower mold 37 and the molds 54, 37 are closed. Then, the lower mold 37 and the upper mold 54 start being lowered integrally. At time H3, which is a predetermined time after time H2 of the mold closing, the lower mold 37 is moved to the lowermost position, and the downward movement of the lower mold 37 and the upper mold 54 is stopped. At time H2, since the pushing rod 40 is moved upward in the closed state, the pressure in the cavity K is gradually increased as indicated by line PK. At time H3, since the pushing rod 40 is moved upward after the movement of the lower mold 37 and the upper mold 54 is stopped, the pressure in the cavity K continues to be increased as indicated by line PK.

On the other hand, at time H3, the clamping cylinder 18 (see FIG. 7) is actuated to clamp the lower mold 37 and the upper mold 54. The clamping is completed at time H4. The clamping pressure applied by the clamping cylinder 18 is indicated by line Pc in FIG. 10. At time H4, where the clamping is completed, the second electromagnetic switch valve 97 is switched from the supply state to the drain state. A little after that, the third electromagnetic switch valve 100 is switched from the drain state to the supply state. As a result, the pressure applied to the first cylinder chamber 91 of the cylinder 74 is switched to the high pressure, so that the pushing rod 40 exerts a higher pressing force. Therefore, as indicated by line PK, the pressure in the cavity K is further increased, and the molten metal Y in the cavity K is further pressurized.

At time H5, which a predetermine time after time H4, the molding operation is finished. At this time, the first electromagnetic switch valve 89 is switched to the drain state, and the third electromagnetic switch valve 100 is switched to the drain state. Also, the upper mold 54 is moved upward, and the lower mold 37 is moved upward, accordingly. Further, the pushing rod 40 is moved downward together with the piston rod 76 of the cylinder 74.

When a predetermined standby period, for example, 0.1 to 2.0 seconds, has elapsed after the second electromagnetic switch valve 97 is switched to the drain state by a control signal from the control unit 94 at time H4 in FIG. 10, the third electromagnetic switch valve 100 is switched to the supply state by a control signal from the control unit 94. During the standby period, the pressured in the cavity K is maintained at a substantially constant level as indicated by line PK. This allows the molten metal Y to be pressurized by an even higher pressure after the molten metal Y in the cavity K reaches the solidification start temperature. This effectively prevents shrinkage cavities from being formed in the product 90. The time at which the molten metal Y reaches the solidification start temperature varies depending on the thickness of the product 90 to be molded. Therefore, the standby period is determined according to the thickness of the product 90 to be molded.

The above described embodiment provides the following advantages.

(1) As shown in FIG. 10, in the open state from time H1 to time H2, the pushing rod 40 is moved upward by the cylinder 74, so that the molten metal Y in the storing chamber 47 is pushed into the cavity K. Thus, when the thickness of the product 90 is small, the molten metal Y is reliably and quickly spread to the entire cavity K. This permits the product 90 having the small thickness to be reliably molded.

A limit is set for the rate at which the upper mold unit 22 is moved downward. Normally, the upper mold unit 22 is moved downward at a rate of 0.4 m/s. To reliably mold the product 90 having a small thickness, the upper mold unit 22 needs to be moved downward at a rate of 1 m/s. In the present embodiment, the pushing rod 40 is smoothly moved upward by the action of the acceleration cylinder 98 provided in the third conduit L3. As a result, the product 90 having a small thickness is reliably molded.

(2) Slightly after time H4, the third electromagnetic switch valve 100 is switched to the supply state, so that a high pressure is applied to the first cylinder chamber 91 of the cylinder 74. Accordingly, the pushing rod 40 pressurizes the molten metal Y in the cavity K with a high pressure. This eliminates bubbles in the molten metal Y and improves the quality (hardness) of the product 90.

(3) The storing chamber 47 has a function of the damper chamber R. Therefore, compared to the embodiment shown in FIGS. 1 to 7, the molding device of the present embodiment has a fewer number of parts and is easier to manufacture, which reduces the costs.

Figure 11:
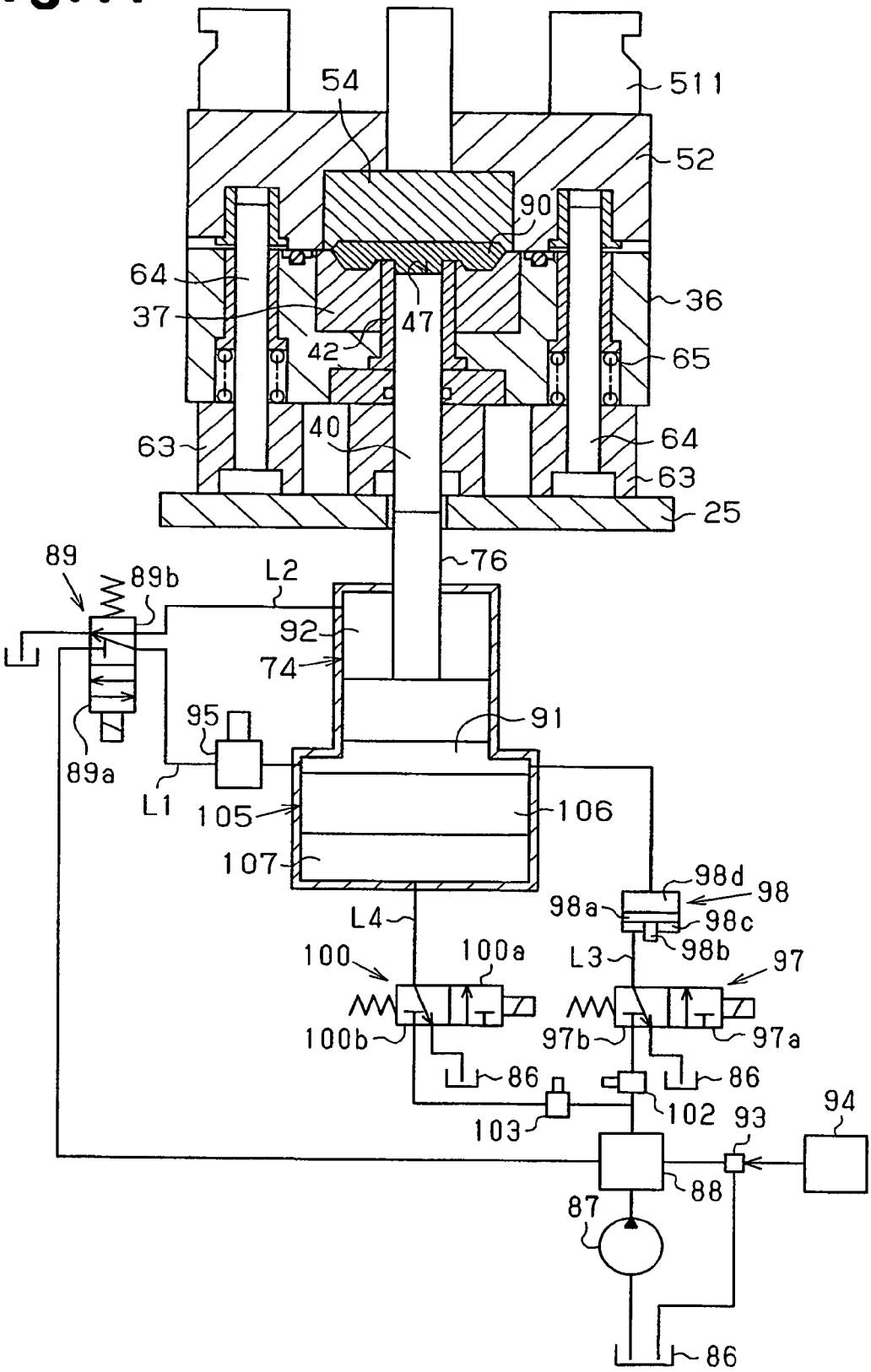
FIG. 11 is a cross-sectional view illustrating a molding device according to another embodiment of the present invention.
Figure 12:
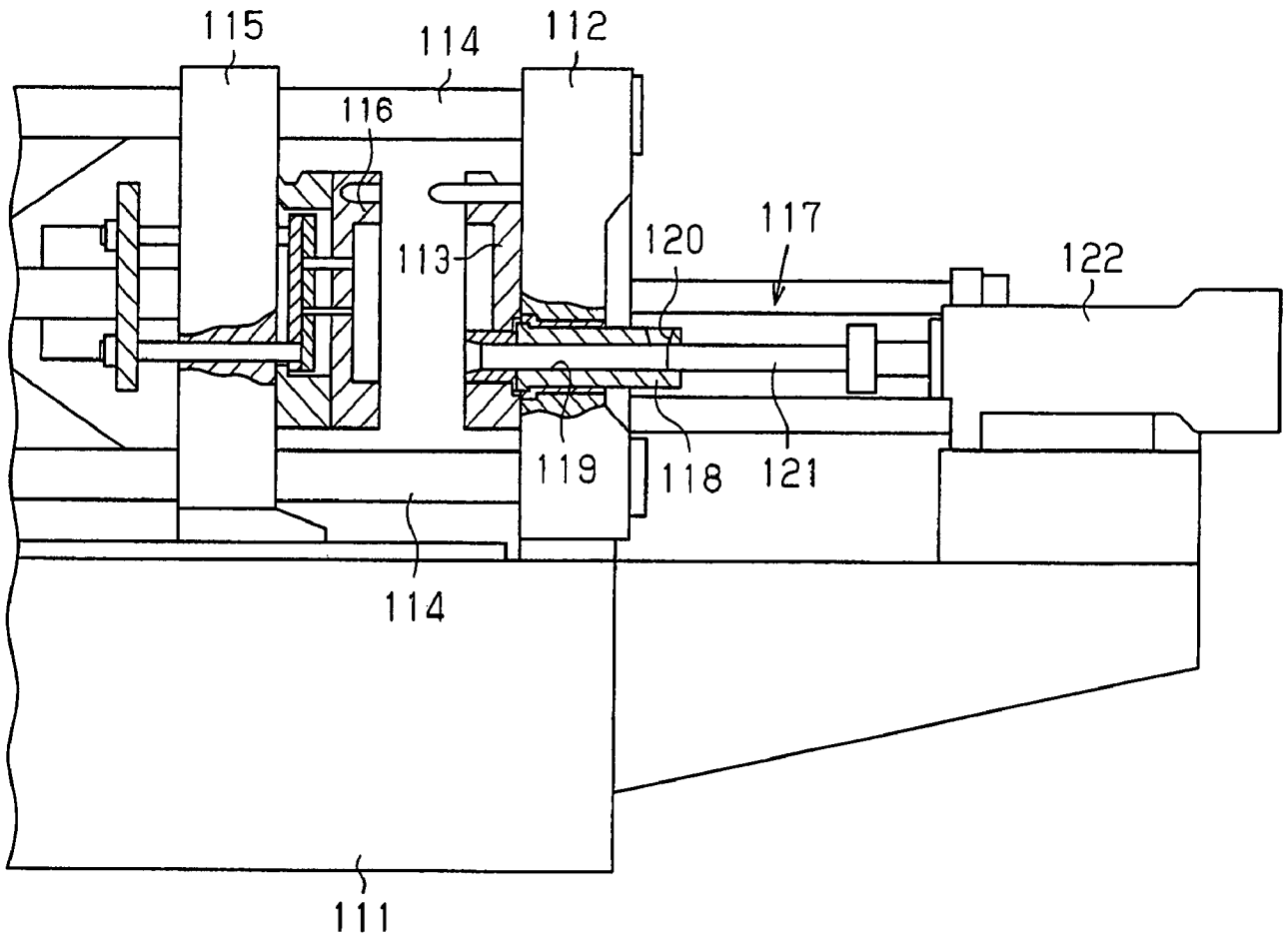
Fig.12(Prior Art)
FIG. 12 is a cross-sectional view illustrating a prior art molding device.

FIG. 11 is a cross-sectional view illustrating a molding device according to a further embodiment of the present invention. In this embodiment, a rodless booster cylinder 105 is attached to the molding device shown in FIG. 8. A first cylinder chamber 91 is defied above the upper surface of a piston 106 of the booster cylinder 105. A pressurizing chamber 107 is defined below the lower surface of the piston 106. A third conduit L3 is connected to the first cylinder chamber 91. A fourth conduit L4 is connected to the pressurizing chamber 107. The first check valve 99 and the second check valve 101 of the embodiment shown in FIG. 8 are omitted in the present embodiment. The other structures are the same as the molding device according to the embodiment of FIG. 8.

In the present embodiment, the booster cylinder 105 is provided so that the pressure in the cavity K can be set to a further higher pressure. The other operations and advantages are the same as those of the embodiment of FIGS. 8 to 10.

The above described embodiments may be modified as follows.

In the embodiment of FIGS. 1 to 7, when pushing of the molten metal Y in the storing chamber 47 by the pushing rod 40 is started, the pressurizing rod 77 may be located at a position where the volume of the damper R is maximized. Then, at the final stage of the pushing or after the pushing, the pressurizing rod 77 is moved toward a position where the volume of the damper chamber R is minimized, so that the excess amount of the molten metal in the damper chamber R is pressurized.

Specifically, before the molding operation is started, the pressurizing rod 77 is arranged in an upper position so that the volume of the damper chamber R is maximized. After the lower mold 37 and the upper mold 54 are clamped, the pushing rod 40 is actuated to move the molten metal Y to the cavity K and the damper chamber R. Therefore, the pressure in the first cylinder chamber 91 is controlled by the first pressure regulating valve 95, such that the pressurizing rod 77 is pushed downward to pressurize the excess amount of the molten metal in the damper chamber R. At this time, the pressurizing rod 77 may first be pressed downward with a low pressure, and pressed with a high pressure when a predetermined period has elapsed. In this case, the excess amount of the molten metal in the damper chamber R is pressurized by a high pressure after being pressurized by a relatively low pressure.

In this modification, filling state of the molten metal in the cavity K is prevented from varying. Also, the molded product is prevented from having shrinkage cavities (bubbles).

The hinge mechanism 26 and the tilt mechanism 27 may be omitted.

The lower mold unit 21 may be configured to be moved forward or rearward in a horizontal direction to a position retreated from the closed position.

The position of the damper R is not limited to the illustrated position. The damper R may be located in an arbitrary position on the first molding surface 371 of the lower mold 37 or the second molding surface 541 of the upper mold 54.

The location of the pushing rod 40 may be changed as necessary.

The mold units 21, 22 do not need to be arranged vertically. That is, a first mold unit and a second mold unit may be provided such that the mold units can approach and separate from each other in a horizontal direction.

The first pressure regulating valve 95 may be located in a section of the second conduit L2 between the first electromagnetic switch valve 89 and the oil tank 86.

The acceleration cylinder 98 may be omitted.

In this specification, the molten material includes semi-solid material in which solid and liquid coexist. That is, in the above embodiments, molding of the product may be performed using semi-solid material as the molten material. For example, a metal material such as aluminum heated to 200 to 300° C. may be stored in the storing chamber 47 to perform hot molding.

Therefore, the present examples and embodiments are to be considered as illustrative and not restrictive and the invention is not to be limited to the details given herein, but may be modified within the scope and equivalence of the appended claims.

The invention claimed is:

1. A molding device comprising:

a lower mold unit having a first molding surface;

an upper mold unit located above the lower mold unit and having a second molding surface, the lower and upper mold units being configured to approach and separate from each other, wherein, when the lower and upper mold units approach each other to be closed, a molding cavity is defined between the molding surfaces of the mold units;

a storing chamber provided in the lower mold unit, the storing chamber being connected to the molding cavity, wherein molten material is stored in the storing chamber;

a pushing mechanism that pushes out the molten material in the storing chamber to the molding cavity in a state where the molding cavity is defined between the lower and upper mold units, wherein the pushing mechanism, including a control means, is adapted to start pushing out the molten material onto the first molding surface of the lower mold unit before the lower and upper units are closed to define the molding cavity;

a damper chamber provided in at least one of the lower and upper mold units, the damper chamber being configured to receive an excess amount of the molten material that cannot be accommodated in the molding cavity; and a pressurizing mechanism for pressurizing the excess amount of the molten material in the damper chamber.

2. The molding device according to claim 1, wherein the pressurizing mechanism is adapted to pressurize the excess amount of the molten material in the damper chamber at a final stage of or after the pushing of the molten material by the pushing mechanism.

3. The molding device according to claim 1, wherein the pressurizing mechanism is adapted to pressurize the excess amount of the molten material in the damper chamber at a relatively low pressure before pressurizing the excess amount of the molten material at a relatively high pressure.

4. The molding device according to claim 1, wherein the storing chamber also functions as the damper chamber, and the pushing mechanism also functions as the pressurizing mechanism.

5. The molding device according to claim 1, wherein the pressurizing mechanism includes a hydraulic cylinder having a piston rod, and a pressurizing member that is accommodated in the damper chamber and is reciprocated by the piston rod.

6. The molding device according to claim 5, wherein the pressurizing member is located at a position for minimizing the volume of the damper chamber when the pushing mechanism starts pushing the molten material, and wherein the hydraulic cylinder is adapted to move the pressurizing member toward a position for maximizing the volume of the damper chamber as the excess amount of the molten material enters the damper chamber with progress of the pushing.

7. The molding device according to claim 5, wherein the pressurizing member is located at a position for maximizing the volume of the damper chamber when the pushing mechanism starts pushing the molten material, and wherein the hydraulic cylinder is adapted to push the pressurizing member toward a position for minimizing the volume of the damper chamber during or after the pushing.

8. The molding device according to claim 7, wherein the pressurizing member is adapted to pressurize the excess amount of the molten material in the damper chamber at a relatively low pressure before pressurizing the excess amount of the molten material at a relatively high pressure.

9. The molding device according to claim 5, wherein the hydraulic cylinder has a piston that divides the interior of the hydraulic cylinder into a first cylinder chamber and a second cylinder chamber, wherein a piston rod extends from the piston and through the second cylinder chamber, and wherein the first cylinder chamber is connected to a fluid supply source via an electromagnetic switch valve, wherein the electromagnetic switch valve is switchable between a supply state for supplying fluid from the fluid supply source to the first cylinder chamber, and a drain state for draining fluid from the first cylinder chamber, and wherein a pressure regulating valve for regulating the pressure in the first cylinder chamber is located between the first cylinder chamber and the electromagnetic switch valve.

10. The molding device according to claim 1, wherein the pushing mechanism includes a pushing rod that is inserted into the storing chamber in a reciprocating manner, and wherein the pushing rod has an end face forming a bottom of the storing chamber.

11. The molding device according to claim 10, wherein the storing chamber also functions as the damper chamber, and the lower mold unit includes a hydraulic cylinder for actuating the pushing rod, the hydraulic cylinder having a piston that divides the interior of the hydraulic cylinder into a first cylinder chamber and a second cylinder chamber, wherein a piston rod extends from the piston and through the second cylinder chamber, the piston rod being coupled to the pushing rod, and wherein the first cylinder chamber is connected to a fluid supply source via an electromagnetic switch valve, wherein the electromagnetic switch valve is switchable between a supply state for supplying fluid from the fluid supply source to the first cylinder chamber, and a drain state for draining fluid from the first cylinder chamber, and wherein a pressure regulating valve for regulating the pressure in the first cylinder chamber is located between the first cylinder chamber and the electromagnetic switch valve.

12. The molding device according to claim 10, wherein the storing chamber also functions as the damper chamber, and the lower mold unit includes a hydraulic cylinder for actuating the pushing rod, the hydraulic cylinder having a piston that divides the interior of the hydraulic cylinder into a first cylinder chamber and a second cylinder chamber, wherein a piston rod extends from the piston and through the second cylinder chamber, the piston rod being coupled to the pushing rod, and wherein the first cylinder chamber is connected to a fluid supply source via a low pressure supply mechanism and a high pressure supply mechanism, which are arranged parallel to each other, arid wherein the low pressure supply mechanism supplies the first cylinder chamber with fluid of a relatively low pressure, and the high pressure supply mechanism supplies the first pressure chamber with fluid of a relatively high pressure.

13. The molding device according to claim 12, wherein the low pressure supply mechanism is adapted to supply the first cylinder chamber with fluid of a relatively low pressure when the pushing rod starts pushing the molten material and to supply the first cylinder chamber with fluid of a relatively high pressure at a final stage of or after the pushing.

14. The molding device according to claim 10, wherein the storing chamber also functions as the damper chamber, and the lower mold unit includes a hydraulic cylinder for actuating the pushing rod, the hydraulic cylinder having a piston that divides the interior of the hydraulic cylinder into a first cylinder chamber and a second cylinder chamber, wherein a piston rod extends from the piston and through the second cylinder chamber, the piston rod being coupled to the pushing rod, wherein a rodless type booster cylinder is coupled to the hydraulic cylinder, the booster cylinder having a pressurizing chamber and a piston, the piston being located between the first cylinder chamber and the pressurizing chamber, and wherein the first cylinder chamber is connected to the fluid supply source via a low pressure supply mechanism that supplies the first cylinder chamber with fluid of a relatively low pressure, wherein the pressurizing chamber is connected to the fluid supply source via a high pressure supply mechanism that supplies the pressurizing chamber with fluid of a relatively high pressure.

15. The molding device according to claim 14, wherein the low pressure supply mechanism is adapted to supply the first cylinder chamber with fluid of a relatively low pressure when the pushing rod starts pushing the molten material and to supply the pressurizing chamber with fluid of a relatively high pressure at a final stage of or after the pushing.

16. A molding device comprising:

a lower mold unit, wherein the lower mold unit includes a horizontal support plate, a lower mold-holding member that is supported on the horizontal support plate to reciprocate in a vertical direction, a lower mold that is held by the lower mold-holding member, and a support rod that lifts the lower mold-holding member and maintains the lower mold-holding member at a predetermined height position from the horizontal support plate;

an upper mold unit arranged above the lower mold unit, the lower and upper mold units being configured to approach and separate from each other, and wherein, when the lower mold unit and the upper mold unit approach each other to be closed, a molding cavity is defined between the lower mold unit and the upper mold unit;

a storing chamber provided in the lower mold unit, the storing chamber being connected to the molding cavity, wherein molten material is stored in the storing chamber;

a pushing mechanism arranged in the lower mold unit for pushing out the molten material in the storing chamber to the molding cavity in a state where the molding cavity is defined between the lower and upper mold units, wherein the pushing mechanism includes a pushing rod that is arranged upward from the horizontal support plate, the pushing rod having an end surface that forms a bottom of the storing chamber, wherein the pushing rod is inserted into the storing chamber to push out the molten material in the storing chamber to the molding cavity as the lower mold-holding member is pushed down toward the horizontal support plate by the upper mold unit, and wherein the pushing mechanism, including a control means, is adapted to start pushing out the molten material onto the first molding surface of the lower mold unit before the lower and upper units are closed to define the molding cavity;

a damper chamber provided in at least one of the lower and upper mold units, the damper chamber being configured to receive an excess amount of the molten material that cannot be accommodated in the molding cavity; and a pressurizing mechanism for pressurizing the excess amount of the molten material in the damper chamber.

* * * * *